US009174481B2

(12) United States Patent
Fuchu et al.

(10) Patent No.: US 9,174,481 B2
(45) Date of Patent: Nov. 3, 2015

(54) BOOKLET STORAGE AND ELECTRONIC APPARATUS

(75) Inventors: Taichi Fuchu, Kanagawa (JP); Hidetoshi Kimura, Kanagawa (JP); Yuko Kamimoto, Kanagawa (JP); Osamu Uto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 315 days.

(21) Appl. No.: 13/439,567

(22) Filed: Apr. 4, 2012

(65) Prior Publication Data

US 2013/0114191 A1 May 9, 2013

(30) Foreign Application Priority Data

Nov. 7, 2011 (JP) ..... 2011-243735

(51) Int. Cl.
*B42D 17/00* (2006.01)
*G03G 21/16* (2006.01)

(52) U.S. Cl.
CPC ..... *B42D 17/00* (2013.01); *G03G 21/16* (2013.01)

(58) Field of Classification Search
CPC ..... A47F 5/10; A47F 7/14; A47F 7/143; B42F 15/0076; B42D 17/00; G03G 21/16
USPC ..... 399/1; 211/42, 43; 220/480
See application file for complete search history.

(56) References Cited

U.S. PATENT DOCUMENTS

| | | | | |
|---|---|---|---|---|
| 5,808,237 | A * | 9/1998 | Hancock | 174/378 |
| D400,926 | S * | 11/1998 | Stravitz | D19/90 |
| 6,454,106 | B1 * | 9/2002 | Howard | 211/50 |
| 6,666,347 | B1 * | 12/2003 | Diamond | 220/4.03 |
| 2011/0126436 | A1 * | 6/2011 | Brozak et al. | 40/124.2 |

FOREIGN PATENT DOCUMENTS

| | | |
|---|---|---|
| JP | A-2007-147709 | 6/2007 |
| JP | B2-4651516 | 3/2011 |

* cited by examiner

*Primary Examiner* — Ryan Walsh
*Assistant Examiner* — Philip Marcus T Fadul
(74) *Attorney, Agent, or Firm* — Oliff PLC

(57) ABSTRACT

A booklet storage includes a first storage member that includes a first receiver portion and a second receiver portion connecting with the first receiver portion; and a second storage member that includes a third receiver portion and a fourth receiver portion connecting with the third receiver portion, wherein the first storage member and the second storage member together receive a booklet in combination, and wherein a first width between the first receiver portion or the second receiver portion and the third receiver portion and a second width between the first receiver portion or the second receiver portion and the fourth receiver portion are different from each other.

24 Claims, 11 Drawing Sheets

BOOKLET STORAGE AND ELECTRONIC APPARATUS

CROSS-REFERENCE TO RELATED APPLICATIONS

This application is based on and claims priority under 35 USC 119 from Japanese Patent Application No. 2011-243735 filed Nov. 7, 2011.

BACKGROUND

Technical Field

The present invention relates to a booklet storage and an electronic apparatus.

SUMMARY

According to an aspect of the invention, there is provided a booklet storage including: a first storage member that includes a first receiver portion and a second receiver portion connecting with the first receiver portion; and a second storage member that includes a third receiver portion and a fourth receiver portion connecting with the third receiver portion, wherein the first storage member and the second storage member together receive a booklet in combination, and wherein a first width between the first receiver portion or the second receiver portion and the third receiver portion and a second width between the first receiver portion or the second receiver portion and the fourth receiver portion are different from each other.

BRIEF DESCRIPTION OF THE DRAWINGS

Exemplary embodiments of the present invention will be described in detail based on the following figures, wherein.

DETAILED DESCRIPTION

Figure 1:
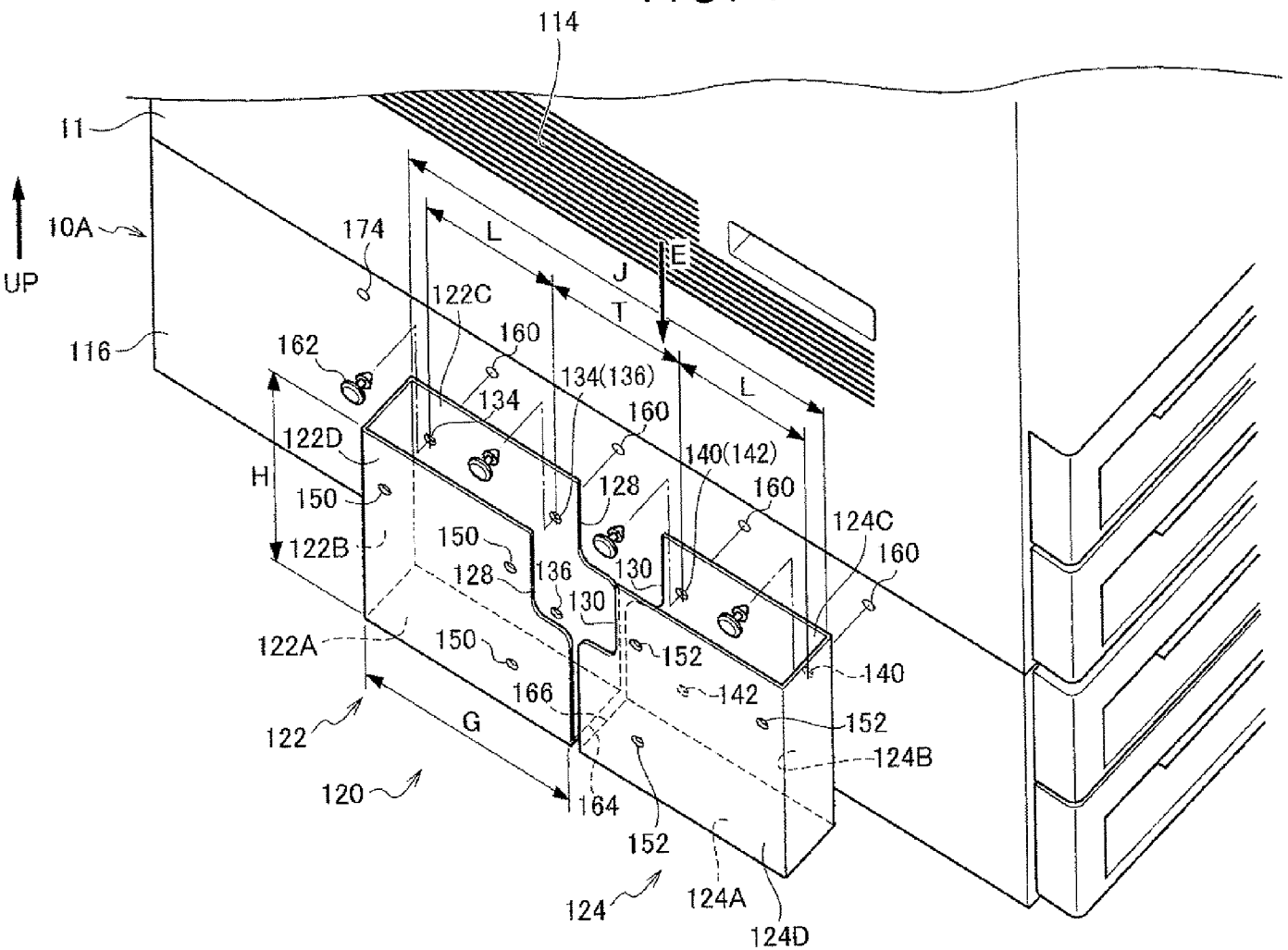
FIG. 1 is an enlarged perspective view illustrating the arrangement when a booklet is placed longitudinally in a booklet storage according to an exemplary embodiment of the invention.

A booklet storage and an electronic apparatus according to an exemplary embodiment of the invention will be described with reference to FIGS. 1 to 11. The arrow UP in the drawings represents the upward direction in the vertical direction.

Figure 9:
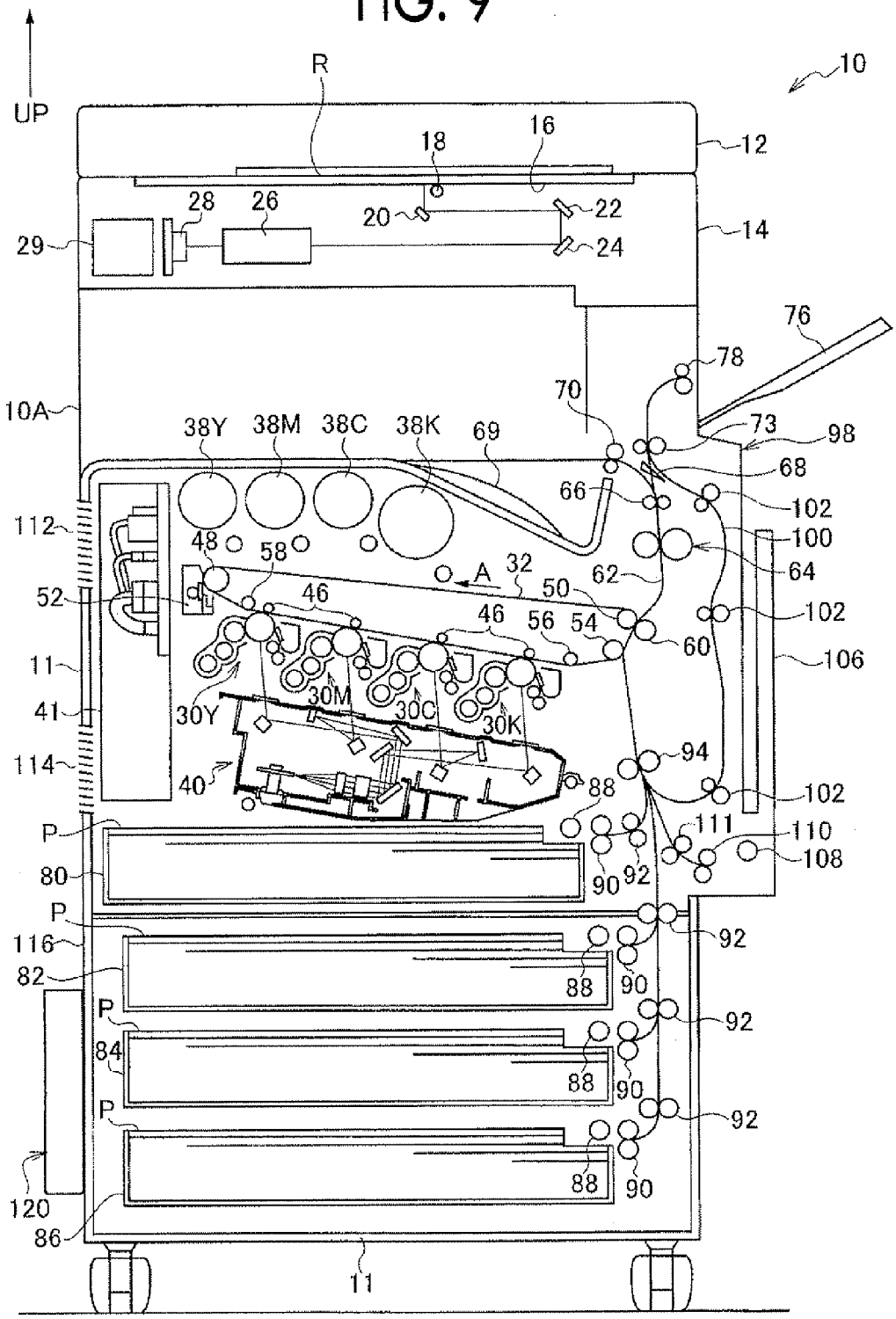
FIG. 9 is a diagram schematically illustrating the configuration of the image forming apparatus according to the exemplary embodiment of the invention.

As shown in FIG. 9, a cover member 12 that can be opened and closed, a glass platen 16 on which a sheet of original document is loaded, and a document reader 14 that reads the original document R loaded onto the glass platen 16 are disposed in the upper part of an apparatus body 10A of an image forming apparatus 10 as an example of the electronic apparatus according to this exemplary embodiment.

A light source 18 irradiating the original document R loaded onto the glass platen 16 with light is disposed in the document reader 14. The document reader 14 is provided with an optical system including a full-rate mirror 20 reflecting the light emitted by the light source 18 and reflected from the original document R in a direction parallel to the glass platen 16, a half-rate mirror 22 reflecting the light reflected by the full-rate mirror 20 downward, a half-rate mirror 24 reflecting and returning the light reflected by the half-rate mirror 22 in the direction parallel to the glass platen 16, and an imaging lens 26 on which the light returned by the half-rate mirror 24 is incident.

The document reader 14 is also provided with a photoelectric conversion device 28 converting the reflected light imaged by the imaging lens 26 into an electrical signal and is also provided with an image processor 29 processing the electrical signal converted by the photoelectric conversion device 28 as an image. The light source 18, the full-rate mirror 20, the half-rate mirror 22, and the half-rate mirror 24 can move along the glass platen 16.

According to this configuration, when reading the original document R loaded onto the glass platen 16, the light source 18 applies light to the original document R loaded onto the glass platen 16 while causing the light source 18, the full-rate mirror 20, the half-rate mirror 22, and the half-rate mirror 24 to move, and the reflected light reflected by the original document R is imaged on the photoelectric conversion device 28.

On the other hand, plural image forming units 30 forming toner images of different colors and being arranged to be inclined about the horizontal direction is disposed at the center of the vertical direction of the apparatus body 10A. An endless intermediate transfer belt 32 wound on a rotating driving roll 48, a tension supplying roll 54 supplying a tension, a support roll 50 rotating with the rotation of the driving roll, a first idler roll 56, and a second idler roll 58 is disposed above the image forming units 30. The toner images formed by the image forming units 30 of different colors are transferred to the intermediate transfer belt 32 while the intermediate transfer belt 32 circulates in the direction of arrow A in the drawing.

Figure 8:
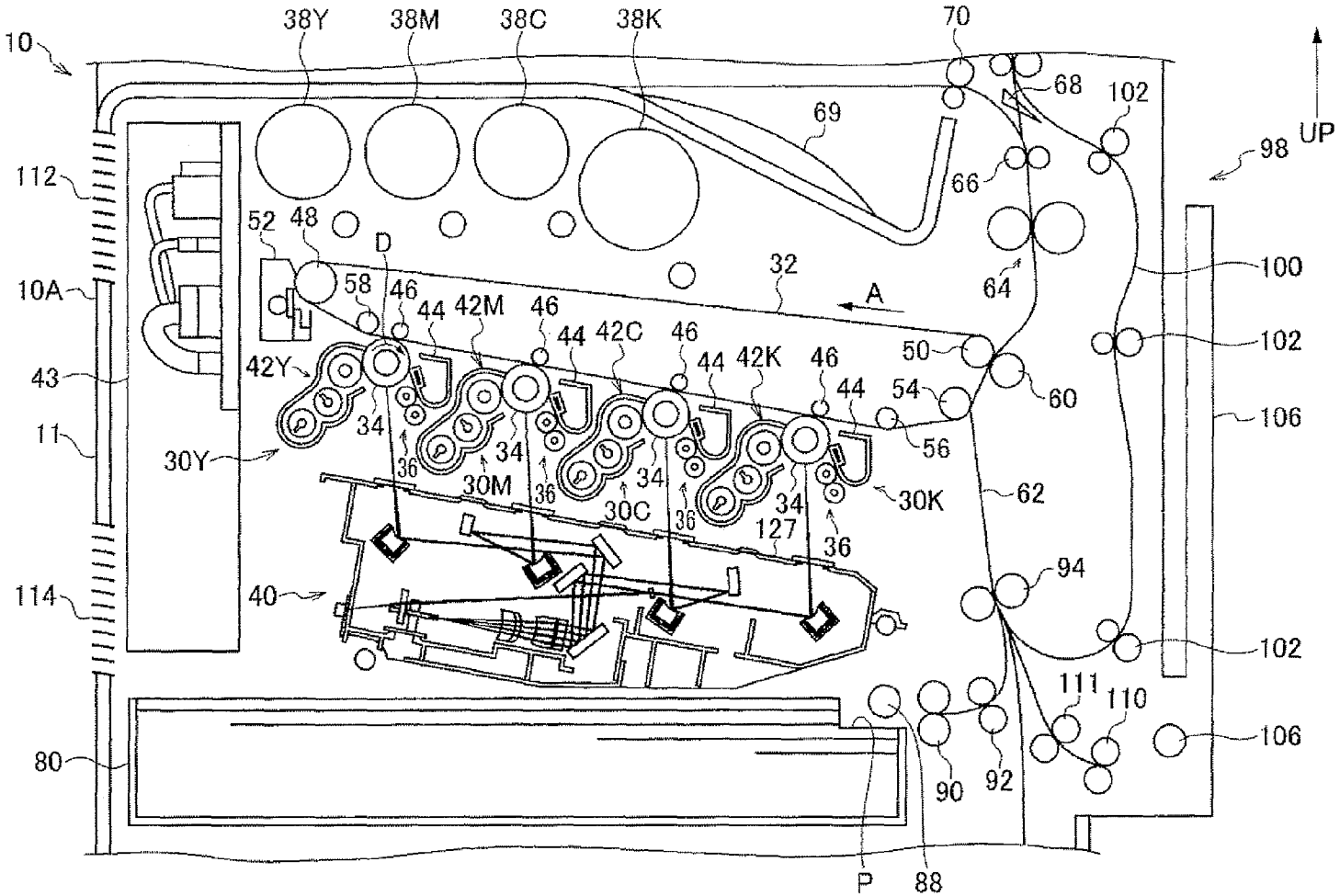
FIG. 8 is a diagram illustrating the configuration of the image forming apparatus according to the exemplary embodiment of the invention.

Specifically, as shown in FIG. 8, four image forming units 30Y, 30M, 30C, and 30K of yellow (Y), magenta (M), cyan (C), and black (K) are arranged in this order. The image forming unit 301 in which the toner image of yellow (Y) to be first transferred to the intermediate transfer belt 32 is formed is located at the highest position, the image forming unit 30K in which the toner image of black (K) to be finally transferred to the intermediate transfer belt 32 is formed is located at the lowest position, and the image forming units 30Y, 30M, 30C, and 30K are arranged at a constant interval in the state where they are inclined about the horizontal direction.

The four image forming units 30Y, 30M, 30C, and 30K have the same basic configuration. In the below description, characters (Y, M, C, and K) corresponding to the colors are attached to the reference signs when the colors are distinguished from each other and the characters corresponding to the colors are not attached when the colors are not particularly distinguished from each other.

The image forming unit 30 of each color includes an image supporting member 34 rotating in the direction of arrow D by the use of a driving unit not shown and a charging member 36 uniformly charging the surface of the image supporting member 34.

An optical scanner 40 irradiating the surface of the image supporting member 34 of which the surface is uniformly charged by the charging member 36 with a laser beam corresponding to a predetermined color to form an electrostatic latent image is disposed below the image forming units 30 so as to be inclined along the plural image forming units 30. A developing device 42 developing the electrostatic latent image formed on the surface of the image supporting member 34 with a toner of a predetermined color to visualize the electrostatic latent image is disposed downstream in the rotation direction of the image supporting member 34 about the charging member 36. A power source unit 43 being arranged in the direction parallel to the optical scanner 40 and supplying power to the image forming units 30 and the like is disposed. A first air inlet and output port 112 and a second air inlet and outlet port 114 penetrating the surface of the side plate 11 of the apparatus body 10A are vertically arranged on the side of the power source unit 43.

On the other hand, a primary transfer member 46 transferring the toner image formed on the surface of the image supporting member 34 to the intermediate transfer belt 32 is disposed on the opposite side of the image supporting member with the intermediate transfer belt 32 interposed therebetween. A cleaning device 44 cleaning the residual toner or the like remaining on the surface of the image supporting member 34 without being transferred to the intermediate transfer belt 32 from the image supporting member 34 is disposed downstream in the rotation direction of the image supporting member 34 about the primary transfer member 46 so as to come in contact with the surface of the image supporting member 34. That is, each image forming unit 30 includes the image supporting member 34, the charging member 36, the developing device 42, and the cleaning device 44.

Toner cartridges 38Y, 38M, 38C, and 38K supplying the toners of predetermined colors to the developing devices 42 of yellow (Y), magenta (M), cyan (C), and black (K), respectively are disposed above the intermediate transfer belt 32. The toner cartridge 38K containing the toner of black (K) has a high use frequency and thus has a size larger than those of the other toner cartridges.

According to this configuration, color image data of yellow (Y), magenta (M), cyan (C), and black (K) are sequentially output to the optical scanner 40 from the image processor 29 (see FIG. 9) or the outside. The laser beam emitted from the optical scanner 40 on the basis of the image data exposes the surface of the corresponding image supporting member 34 to form an electrostatic latent image on the surface of the image supporting member 34. The electrostatic latent images formed on the surfaces of the image supporting members 34 are developed as the color toner images of yellow (Y), magenta (M), cyan (C), and black (K) by the developing devices 42Y, 42M, 42C, and 42K.

The toner images of yellow (Y), magenta (M), cyan (C), and black (K) sequentially formed on the surfaces of the image supporting members 34 are multiply-transferred to the intermediate transfer belt 32 disposed inclined above the image forming units 30Y, 30M, 30C, and 30K of the colors by the primary transfer member 46.

On the other hand, the cleaning device 52 cleaning the surface of the intermediate transfer belt 32 is disposed on the opposite side of the driving roll 48 with the intermediate transfer belt 32 interposed therebetween. The cleaning device 52 may be detached from and attached to the apparatus body 10A by opening the front cover (not shown) disposed on the front surface (the front side where a user stands) of the apparatus body 10A.

A secondary transfer member 60 secondarily transferring the toner images primarily transferred to the intermediate transfer belt 32 to a sheet member P as a recording medium is disposed on the opposite side of the support roll 50 with the intermediate transfer belt 32 interposed therebetween. That is, a position between the secondary transfer member 60 and the support roll 50 serves as a secondary transfer position where the toner images are transferred to the sheet member P.

A fixing device 64 fixing the toner images to the sheet member P to which the toner images are transferred by the secondary transfer member 60 and which is transported along a transport path 62 is disposed above the secondary transfer member 60.

As shown in FIG. 9, a transport roll 66 transporting a sheet member P to which the toner image is fixed is disposed downstream in the transport direction of the sheet member P about the fixing device 64 (hereinafter, simply referred to as "downstream in the transport direction") and a switching gate 68 switching the transport direction of the sheet member P is disposed downstream in the transport direction about the transport roll 66.

A first discharge roll 70 discharging the sheet member P, which is guided by the switching gate 68 switched to one direction, to the first discharge section 69 is disposed downstream in the transport direction about the switching gate 68.

A second discharge roll 78 discharging the sheet member P, which is guided by the switching gate 68 switched to the other direction and transported by the transport roll 73, to the second discharge section 76 is disposed downstream in the transport direction about the switching gate 68.

On the other hand, sheet feeding sections 80, 82, 84, and 86 storing sheet members P are disposed in the lower part of the apparatus body 10A and upstream in the transport direction of the sheet member P (hereinafter, simply referred to as "upstream in the transport direction") about the secondary transfer member 60. Sheet members P having different sizes are stored in the sheet feeding sections 80, 82, 84, and 86.

Each of the sheet feeding sections 80, 82, 84, and 86 is provided with a feed roll 88 sending the sheet member P from each of the sheet feeding sections 80, 82, 84, and 86 to a transport path 62. A transport roll 90 and a transport roll 92 transporting the sheet members P sheet by sheet are disposed downstream in the transport direction about the feed roll 88.

A registration roll 94 temporarily stopping the sheet member P and sending the sheet member P to the secondary transfer position at a predetermined time is disposed downstream in the transport direction about the transport roll 92.

On the other hand, a double-side transport unit 98 inverting and transporting the sheet member P to form images on both sides of the sheet member P is disposed aside the secondary transfer position. The double-side transport unit 98 is provided with an inversion path 100 through which the sheet member P transported by inversely rotating the transport roll 73 passes. Plural transport rolls 102 are disposed along the inversion path 100 and the sheet member P transported by the transport rolls 102 is transported again to the registration roll 94 in the state where it is upside down.

A foldable manual bypass feed unit 106 is disposed around the double-side transport unit 98. A feed roll 108 and transport rolls 110 and 111 transporting a sheet member P fed from the opened foldable manual bypass unit 106 are provided and the sheet member P transported by the transport rolls 110 and 111 are transported to the registration roll 94.

A booklet storage 120 which is attached to a side plate 116 as an example of an attachment member disposed below the side plate 11 having the first air inlet and outlet port 112 and the second air inlet and outlet port 114 formed therein and which stores a booklet S in which the operation sequences of the image forming apparatus 10 and the like are described will be described below.

As shown in FIG. 1, the booklet storage 120 includes a first storage member 122 and a second storage member 124 having substantially a symmetric shape and can store a booklet S by arranging the first storage member 122 and the second storage member 124 in a horizontal direction.

Figure 2:
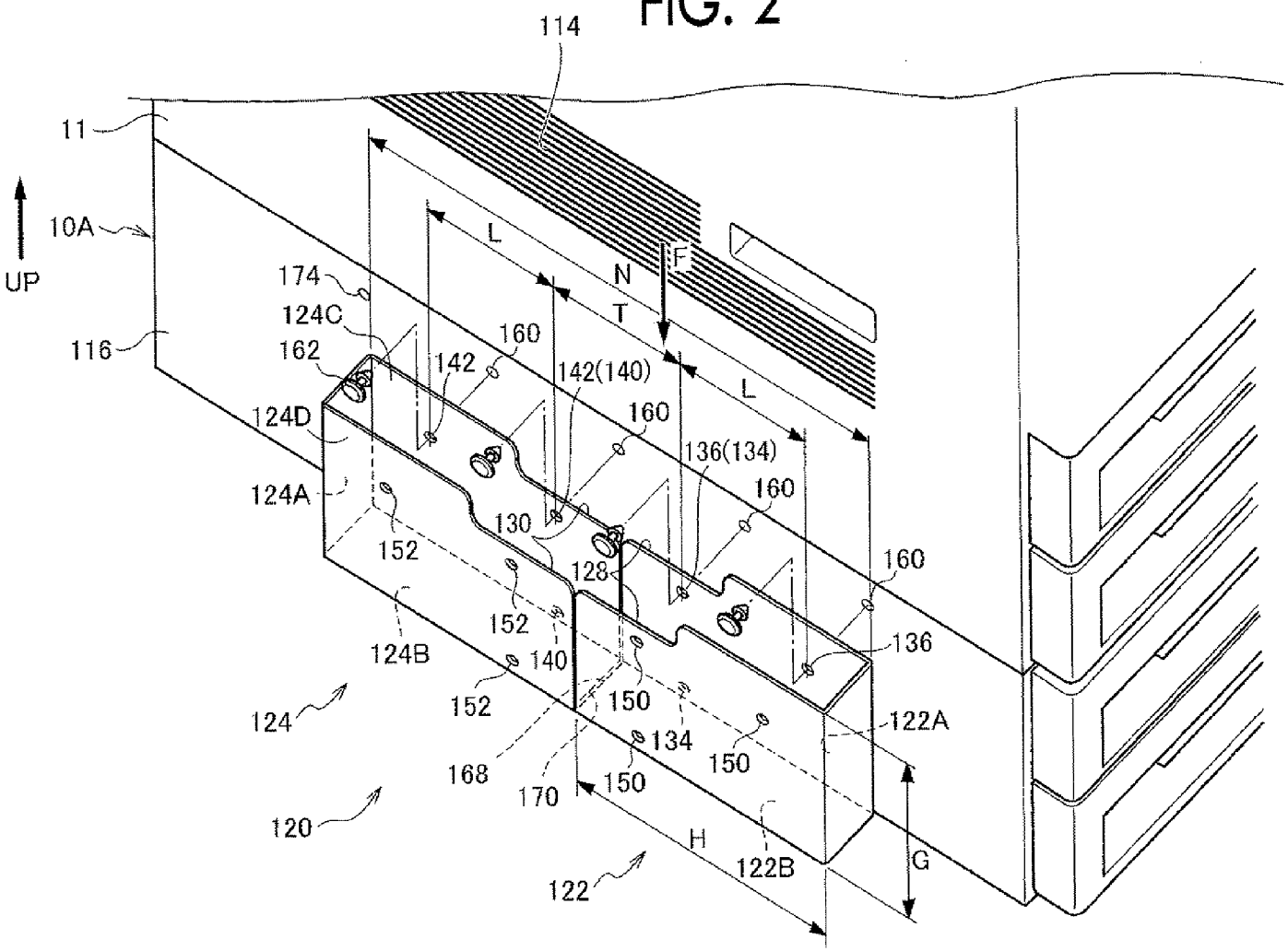
FIG. 2 is an enlarged perspective view illustrating the arrangement when a booklet is placed transversely in the booklet storage according to the exemplary embodiment of the invention.

FIG. 1 shows the booklet storage 120 when a booklet S of an A4 size is placed longitudinally (hereinafter, referred to as "in the longitudinal arrangement of a booklet") and FIG. 2 shows the booklet storage 120 when a booklet S of an A4 size is placed transversely (hereinafter, referred to as "in the transversal arrangement of a booklet").

Specifically, as shown in FIG. 1, the first storage member 122 in the longitudinal arrangement of a booklet is disposed on the left side in the drawing surface and the second storage member 124 is disposed on the right side of the drawing surface. On the other hand, as shown in FIG. 2, the first storage member 122 in the transversal arrangement of a booklet is disposed on the right side of the drawing surface in a state where the attachment direction is rotated counterclockwise by substantially 90 degrees about the posture in the longitudinal arrangement of a booklet and the second storage member 124 is disposed on the left side of the drawing surface in a state where the attachment direction clockwise by substantially 90 degrees about the posture in the longitudinal arrangement of a booklet.

As shown in FIGS. 1 and 2, the first storage member 122 includes a first receiver portion 122A (see FIG. 1) having a rectangular panel shape and receiving an end face of a booklet S in the longitudinal arrangement of the booklet and a second receiver portion 122B (see FIG. 2) having a rectangular panel shape and receiving an end face of a booklet S in the transversal arrangement of the booklet. The first receiver portion 122A and the second receiver portion 122B are connected to each other at the ends in the length direction and the angle formed by the first receiver portion 122A and the second receiver portion 122B is substantially 90 degrees.

The booklet support width (the size G shown in the drawing) of the first receiver portion 122A receiving the end face of a booklet S in the longitudinal arrangement of the booklet is smaller than the booklet support width (the size H shown in the drawing) of the second receiver portion 122B receiving the end face of a booklet S in the transversal arrangement of the booklet.

In the first storage member 122, a pair of plate-like wall portions 122C and 122D supporting the cover surfaces (including the rear cover surface) of the booklet S stored in the first storage member 122, having substantially the same shape, and facing each other are connected to edge portions in which the width directions of the first receiver portion 122A and the second receiver portion 122B are different from each other. A cutout 128 reducing the storage depth of the booklet S and having an L-shaped edge is formed in the wall portion 122C and the wall portion 122D.

Similarly, the second storage member 124 includes a third receiver portion 124A (see FIG. 1) having a rectangular panel shape and receiving the end face of a booklet S in the longitudinal arrangement of the booklet and a fourth receiver portion 124B (see FIG. 2) having a rectangular panel shape and receiving the end face of a booklet S in the transversal arrangement of the booklet. The third receiver portion 124A has substantially the same shape as the first receiver portion 122A and the fourth receiver portion 124B has substantially the same shape as the second receiver portion 122B. Similarly to the first receiver portion 122A and the second receiver portion 122B, the third receiver portion 124A and the fourth receiver portion 124B are connected to each other at the ends in the length direction and the angle formed by the third receiver portion 124A and the fourth receiver portion 124B is substantially 90 degrees.

In the second storage member 124, a pair of plate-like wall portions 124C and 124D supporting the cover surfaces (including the rear cover surface) of the booklet S stored in the second storage member 124, having the same shape, and facing each other are connected to edge portions in which the width directions of the third receiver portion 124A and the fourth receiver portion 124B are different from each other. The wall portion 124C and the wall portion 124D have substantially the same shapes as the wall portion 122C and the wall portion 122D, respectively, and a cutout 130 having the same shape as the cutout 128 is formed in the wall portion 124C and the wall portion 124D.

Specifically, the shape of the cutout 128 and the cutout 130 is determined so that even when a CD (Compact Disk) case K having a CD storing software such as a printer driver as data is stored in the booklet storage 120 in the longitudinal arrangement of a booklet and in the transversal arrangement of a booklet, a user can take out the CD case K. That is, at least a part of the CD case K stored in the booklet storage 120 is exposed from the cutout 128 or the cutout 130 to outside (see FIGS. 3 and 4).

According to this configuration, by causing the opening edge 164 of the first receiver portion 122A and the opening edge 166 of the third receiver portion 124A to face each other so that the plate surface of the first receiver portion 122A and the third receiver portion 124A faces the longitudinal direction in the longitudinal arrangement of a booklet as shown in FIG. 1, the postures of the first storage member 122 and the second storage member 124 may be determined. Accordingly, a first width (the size J shown in FIG. 1) may be achieved which may be set when a booklet S of an A4 size is arranged longitudinally. The end face of the booklet S stored from a first storage direction (the direction of arrow E shown in FIG. 1) is received by the first receiver portion 122A and the third receiver portion 124A. In this state, the booklet S may not be arranged transversely. The wall portion 122C of the first storage member 122 and the wall portion 124C of the second storage member 124 come in contact with the side plate 116.

On the other hand, as shown in FIG. 2, the postures of the first storage member 122 and the second storage member 124 may be determined in the transversal arrangement of a booklet by causing the opening edge 168 of the second receiver portion 122B and the opening edge 170 of the fourth receiver portion 124B to come in contact with each other so that the plate surface of the second receiver portion 122B and the fourth receiver portion 124B faces the vertical direction. Accordingly, a second width (the size N shown in FIG. 2) may be achieved which is different from the first width and which may be applied when a booklet S of an A4 size is arranged transversely. The end face of the booklet S stored from a second storage direction (in the direction of arrow F in FIG. 2) is received by the second receiver portion 122B and the fourth receiver portion 124B. In this state, similarly to the longitudinal arrangement of a booklet, the wall portion 122C of the first storage member 122 and the wall portion 124C of the second storage member 124 come in contact with the side plate 116.

As shown in FIG. 1, in the first storage member 122, first attachment holes 134 as an example of plural (two in this exemplary embodiment) first attachment portions used in the longitudinal arrangement of a booklet are formed in the wall portion 122C attached to the side plate 116 of the apparatus body 10A. Specifically, two first attachment holes 134 are arranged in the horizontal direction in the posture in the longitudinal arrangement of a booklet and the pitch therebetween is defined as a distance L.

Similarly, as shown in FIG. 2, in the first storage member 122, second attachment holes 136 as an example of plural (two in this exemplary embodiment) second attachment portions used in the transversal arrangement of a booklet are formed in the wall portion 122C attached to the side plate 116 of the apparatus body 10A. Specifically, two second attachment holes 136 are arranged in the vertical direction in the posture in the transversal arrangement of a booklet and the pitch therebetween is defined as a distance L, similarly to the first attachment holes 134.

The first attachment hole 134 (see FIG. 1) disposed on the side of the first storage member 122 in the longitudinal arrangement of a booklet and the second attachment hole 136 (see FIG. 2) disposed on the side of the first storage member 122 in the transversal arrangement of a booklet are used in common (are the same hole).

On the other hand, as shown in FIG. 1, in the second storage member 124, third attachment holes 140 as an example of plural (two in this exemplary embodiment) third attachment portions used in the longitudinal arrangement of a booklet are formed in the wall portion 124C attached to the side plate 116 of the apparatus body 10A. Specifically, two third attachment holes 140 are arranged in the horizontal direction in the posture in the longitudinal arrangement of a booklet and the pitch therebetween is defined as a distance L.

Similarly, as shown in FIG. 2, in the second storage member 124, fourth attachment holes 142 as an example of plural (two in this exemplary embodiment) fourth attachment portions used in the transversal arrangement of a booklet are formed in the wall portion 124C attached to the side plate 116 of the apparatus body 10A. Specifically, two fourth attachment holes 142 are arranged in the vertical direction in the posture in the transversal arrangement of a booklet and the pitch therebetween is defined as a distance L, similarly to the third attachment holes 140.

That is, the first attachment holes 134, the second attachment holes 136, the third attachment holes 140, and the fourth attachment holes 142 are arranged to be substantially symmetric about a virtual center line extending in the vertical direction and being drawn between the first storage member 122 and the second storage member 124.

The third attachment hole 140 (see FIG. 1) disposed on the side of the second storage member 124 in the longitudinal arrangement of a booklet and the fourth attachment hole 142 (see FIG. 2) disposed on the side of the second storage member 124 in the transversal arrangement of a booklet are used in common (are the same hole).

The positions of the attachment holes are determined so that the relative positional relationship between the plural first attachment holes 134 and the plural third attachment holes 140 when the first storage member 122 and the second storage member 124 are arranged to form the first width in the longitudinal arrangement of a booklet is substantially identical to the relative positional relationship between the plural second attachment holes 136 and the plural fourth attachment holes 142 when the first storage member 122 and the second storage member 124 are arranged to form the second width in the transversal arrangement of a booklet.

Specifically, the positions of the attachment holes are determined so that the pitch of the attachment holes formed in the same member is the distance L and the pitch of the attachment holes between the members is a distance T different from the distance L.

Figure 11:
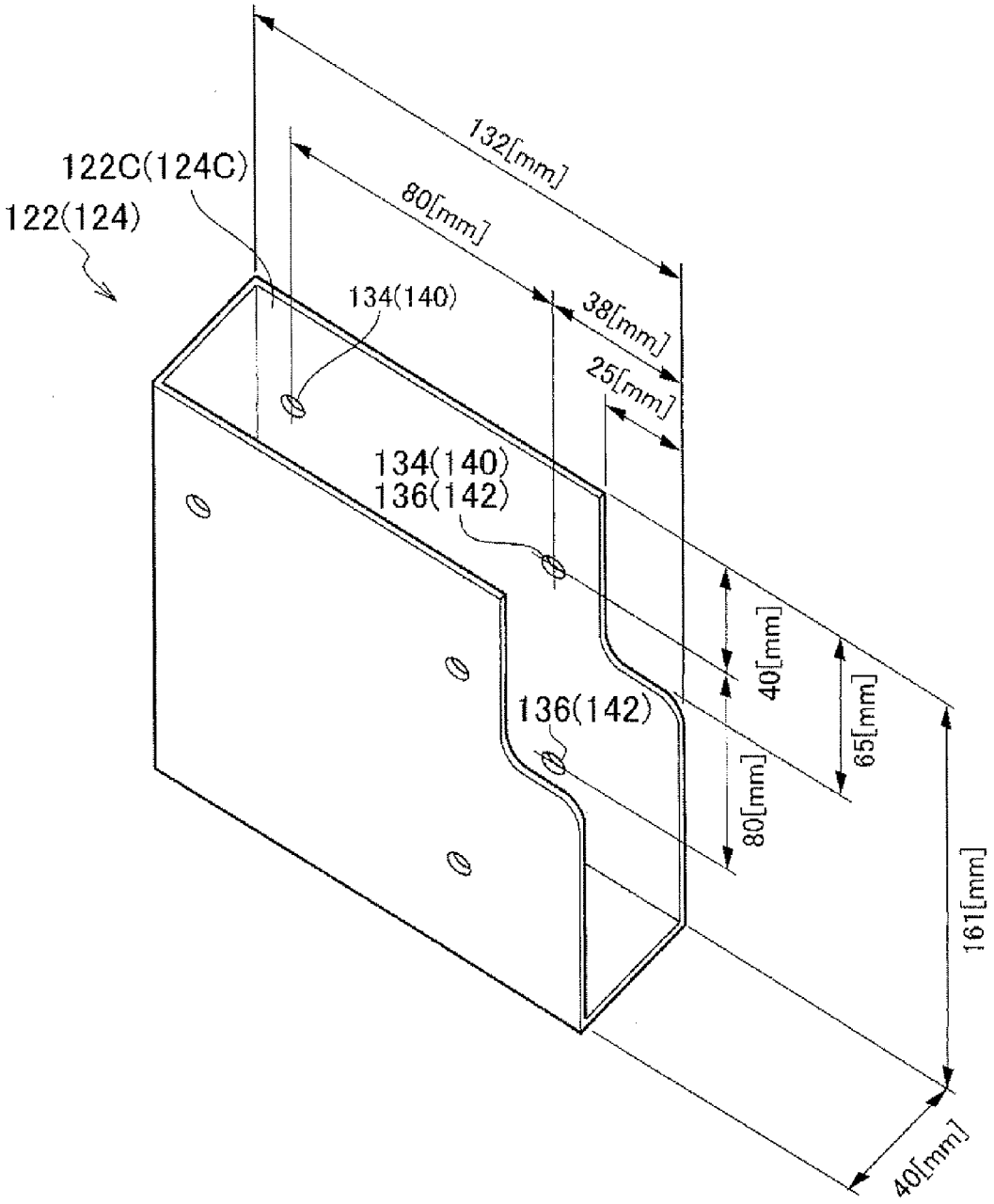
FIG. 11 is a perspective view illustrating examples of sizes of members of the booklet storage according to the exemplary embodiment of the invention.

In the first storage member 122, the same attachment holes 150 as the attachment holes 134 and 136 formed in the wall portion 122C are formed in the wall portion 122D facing the wall portion 122C. Similarly, in the second storage member 124, the same attachment holes 152 as the attachment holes 140 and 142 formed in the wall portion 124C are formed in the wall portion 124D facing the wall portion 124C. Accordingly, the first storage member 122 and the second storage member 124 have substantially the same shape. FIG. 11 shows an example of the sizes in the first storage member 122 and the second storage member 124 having the same shape.

Attachment holes formed in the side plate 116 and used to attach the booklet storage 120 to the apparatus body 10A will be described below.

Figure 3:
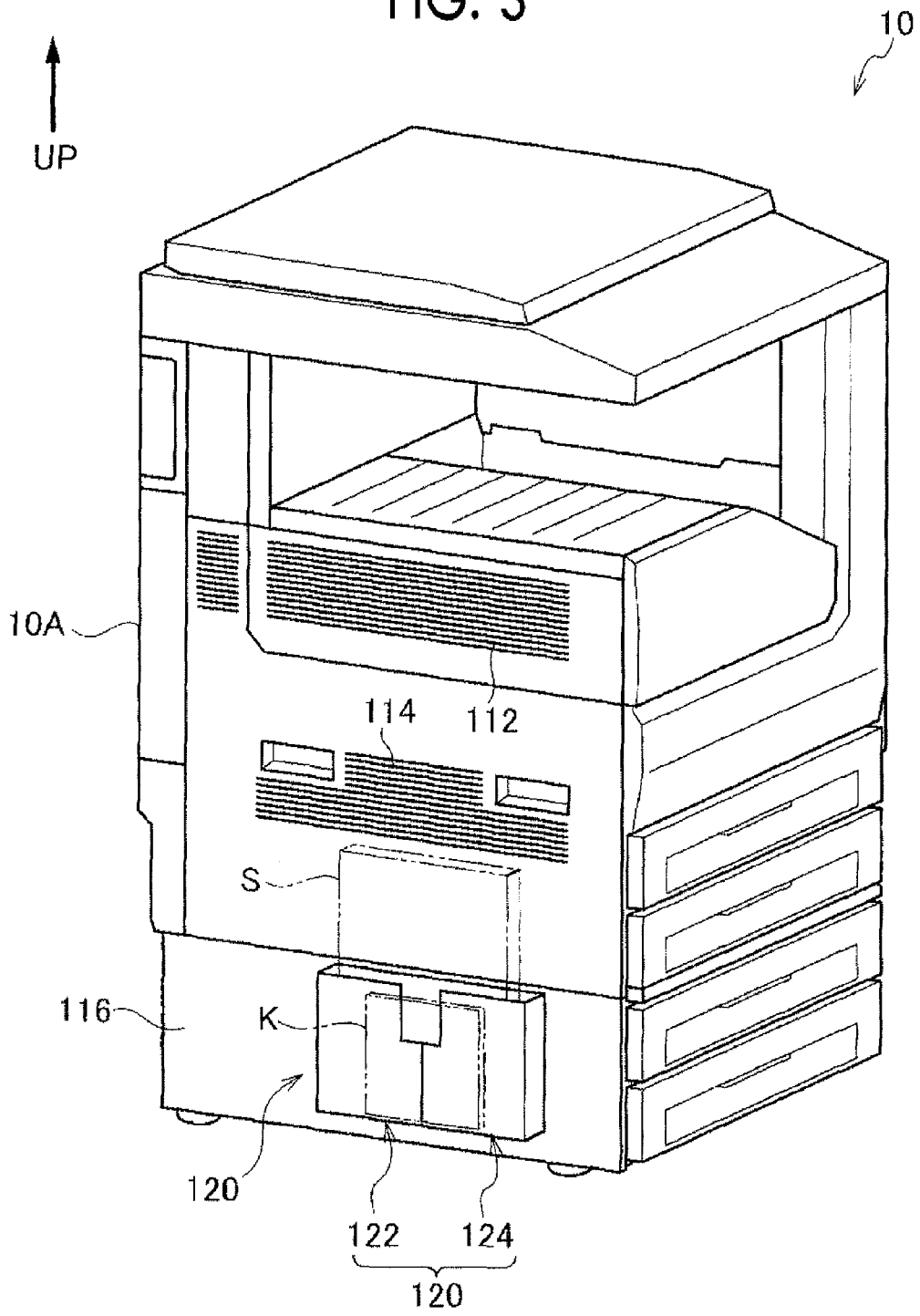
FIG. 3 is a perspective view illustrating the booklet storage and an image forming apparatus when a booklet is placed longitudinally according to the exemplary embodiment of the invention.

As shown in FIGS. 1 and 3, four attachment holes 160 as an example of the attachment portions corresponding to the first attachment holes 134 and the third attachment holes 140 when the first storage member 122 and the second storage member 124 are arranged to form the first width in the longitudinal arrangement of a booklet are formed in the side plate 116.

According to this configuration, fasteners 162 as an example of a fixing tool are inserted into the first attachment holes 134 and the attachment holes 160 to fix the first storage member 122 to the side plate 116. Similarly, the fasteners 162 are inserted into the third attachment holes 140 and the attachment holes 160 to fix the second storage member 124 to the side plate 116.

As described above, the relative positional relationship between the plural first attachment holes 134 and the plural third attachment holes 140 in the longitudinal arrangement of a booklet is equal to the relative positional relationship between the plural second attachment holes 136 and the plural fourth attachment holes 142 in the transversal arrangement of a booklet.

Accordingly, as shown in FIG. 2, when the first storage member 122 and the second storage member 124 are arranged to form the second width in the transversal arrangement of a booklet, the attachment holes 160, the second attachment holes 136, and the fourth attachment holes 142 correspond to each other. Accordingly, the fasteners 162 are inserted into the second attachment holes 136 and the attachment holes 160 to fix the first storage member 122 to the side plate 116. Similarly, the fasteners 162 are inserted into the fourth attachment holes 142 and the attachment holes 160 to fix the second storage member 124 to the side plate 116. That is, the attachment holes 160 formed in the side plate 116 are used in common in the longitudinal arrangement of a booklet and in the transversal arrangement of a booklet.

Figure 4:
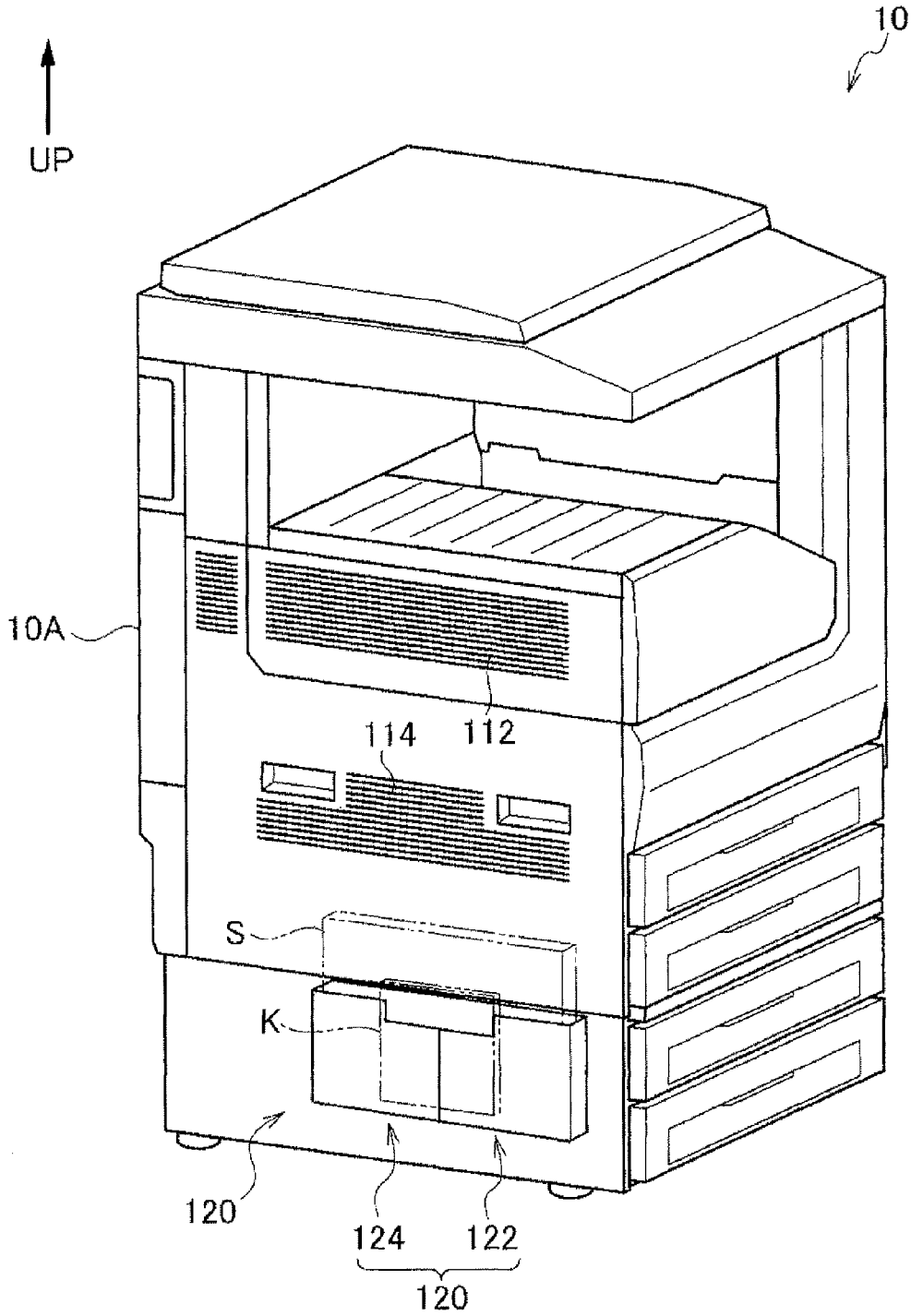
FIG. 4 is a perspective view illustrating the booklet storage and the image forming apparatus when a booklet is placed transversely according to the exemplary embodiment of the invention.

As shown in FIGS. 3 and 4, even when a booklet S of an A4 size is longitudinally stored in the booklet storage 120 in the longitudinal arrangement of a booklet (see FIG. 3) and even when the booklet S of an A4 size is transversely stored in the booklet storage 120 in the transversal arrangement of a booklet (see FIG. 4), the positions of the attachment holes 160 (see FIGS. 1 and 2) are determined so as for the booklet S not to cover the openings of the first air inlet and outlet port 112 and the second air inlet and outlet port 114.

Figure 5:
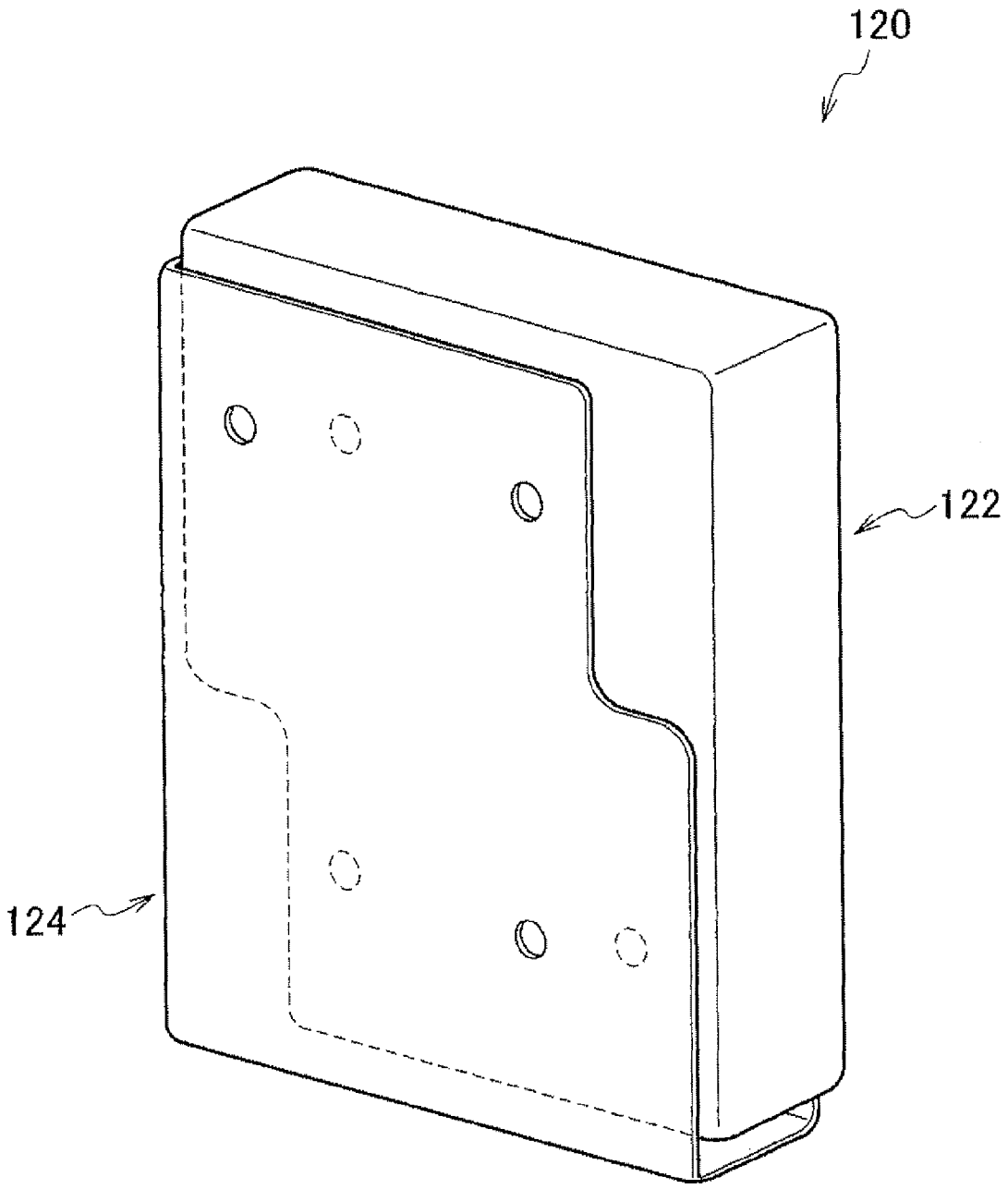
FIG. 5 is an enlarged perspective view illustrating the booklet storage according to the exemplary embodiment of the invention when it is carried.

As shown in FIG. 5, at the time of shipment of the image forming apparatus 10 (see FIG. 9) from a plant, the first storage member 122 and the second storage member 124 may be tied to each other so as to combine the opening of the first storage member 122 and the opening of the second storage member 124. The first storage member 122 and the second storage member 124 may be shipped and carried in the tied state.

As shown in FIGS. 1 and 3, in the longitudinal arrangement of a booklet, the first storage member 122 is disposed on the left side of the drawing surface, the second storage member 124 is disposed on the right side of the drawing surface, and the opening edge 164 of the first receiver portion 122A and the opening edge 166 of the third receiver portion 124A are opposed to each other. Accordingly, the first storage member 122 and the second storage member 124 are arranged to form the first width in the longitudinal arrangement of a booklet.

In this state, the fasteners 162 are inserted into the first attachment holes 134 and the attachment holes 160 to fix the first storage member 122 to the side plate 116. Similarly, the fasteners 162 are inserted into the third attachment holes 140 and the attachment holes 160 to fix the second storage member 124 to the side plate 116. In the state where a booklet S of an A4 size is longitudinally arranged in the booklet storage 120, the booklet S does not cover the openings of the first air inlet and outlet port 112 and the second air inlet and outlet port 114.

On the other hand, in the transversal arrangement of a booklet, the first storage member 122 is disposed on the right side of the drawing surface and the second storage member 124 is disposed on the left side of the drawing surface, as shown in FIGS. 2 and 4. Compared with the longitudinal arrangement of a booklet, the attachment directions of the first storage member 122 and the second storage member 124 are changed and the opening edge 168 of the second receiver portion 122B and the opening edge 170 of the fourth receiver portion 124B are brought into contact with each other.

In this state, the fasteners 162 are inserted into the second attachment holes 136 and the attachment holes 160 to fix the first storage member 122 to the side plate 116. Similarly, the fasteners 162 are inserted into the fourth attachment holes 142 and the attachment holes 160 to fix the second storage member 124 to the side plate 116. In the state where a booklet S of an A4 size is transversely arranged in the booklet storage 120, the booklet S does not cover the openings of the first air inlet and outlet port 112 and the second air inlet and outlet port 114.

As described above, by dividing the booklet storage 120 into the first storage member 122 and the second storage member 124 and changing the attachment directions of the first storage member 122 and the second storage member 124, the first width and the second width different from the first width are formed. Accordingly, when the first width and the second width are used depending on applications thereof by the use of the first storage member 122 and the second storage member 124, it is possible to select the direction in which a booklet S is placed.

The same attachment holes 150 as the attachment holes 134 and 136 formed in the wall portion 122C are formed in the wall portion 122D facing the wall portion 122C in the first storage member 122. Similarly, the same attachment holes 152 as the attachment holes 140 and 142 formed in the wall portion 124C are formed in the wall portion 124D facing the wall portion 124C in the second storage member 124. The cutout 130 having the same shape as the cutout 128 formed in the first storage member 122 is formed in the second storage member 124. Accordingly, the first storage member 122 and the second storage member 124 have substantially the same shape. The first storage member 122 may be attached to the side plate 116 by using the wall portion 122D instead of the wall portion 122C, and the second storage member 124 may be attached to the side plate 116 by using the wall portion 124D instead of the wall portion 124C. That is, without changing the arrangement of the first storage member 122 and the second storage member 124, the first width in the longitudinal arrangement of a booklet and the second width in the transversal arrangement of a booklet may be formed by the use of the first storage member 122 and the second storage member 124.

By forming the cutout 128 in the first storage member 122 and forming the cutout 130 in the second storage member 124, at least a part of the CD case K stored in the booklet storage 120 is externally exposed from the cutout 128 or the cutout 130 in the longitudinal arrangement of a booklet and the transversal arrangement of a booklet.

In this Exemplary embodiments of the invention, the relative positional relationship between the plural (two in this exemplary embodiment) first attachment holes 134 and the plural (two in this exemplary embodiment) third attachment holes 140 when forming the first width is substantially identical to the relative positional relationship between the plural (two in this exemplary embodiment) second attachment holes 136 and the plural (two in this exemplary embodiment) fourth attachment holes 142 when forming the second width. Accordingly, the attachment holes 160 formed in the side plate 116 may be used in common in the longitudinal arrangement of a booklet and in the transversal arrangement of a booklet.

Regarding the pitches of the attachment holes having the same relative positional relationship, the pitch of the attachment holes formed in the same member is the distance L and the pitch of the attachment holes between the members is the distance T different from the distance L.

When a booklet S of an A4 size is arranged longitudinally (see FIG. 3) and when a booklet S of an A4 size is arranged transversely (see FIG. 4), the position of the attachment holes 160 are determined so as for the booklet S not to cover the opening of the first air inlet and outlet port 112 and the opening of the second air inlet and outlet port 114.

While the invention has been described in detail with reference to a specific exemplary embodiment, the invention is not limited to the exemplary embodiment, but may be modified in various forms without departing from the scope of the invention, which is obvious to those skilled in the art. For example, the booklet storage 120 is used in combination with the image forming apparatus 10 in the above-mentioned exemplary embodiment, but is not limited to the image forming apparatus 10 and may be used in combination with an electronic apparatus such as a facsimile.

In the above-mentioned exemplary embodiment, it has been stated that a booklet S of an A4 size is arranged longitudinally and transversely. However, for example, when the size of the booklet S varies depending on the types (for example, an A4 size and an A3 size), different booklet widths (booklet sizes) may be coped with by the use of the booklet storage 120.

Although it has been stated in the above-mentioned exemplary embodiment that the first storage member 122 and the second storage member 124 have substantially the same shape, the first storage member and the second storage member are not limited to substantially the same shape or the substantially symmetric shape, but may have different shapes.

It has been stated in the above-mentioned exemplary embodiment that the first receiver portion 122A (the third receiver portion 124A) and the second receiver portion 122B (the fourth receiver portion 124B) are connected to each other, but they may be separated from each other.

Figure 6:
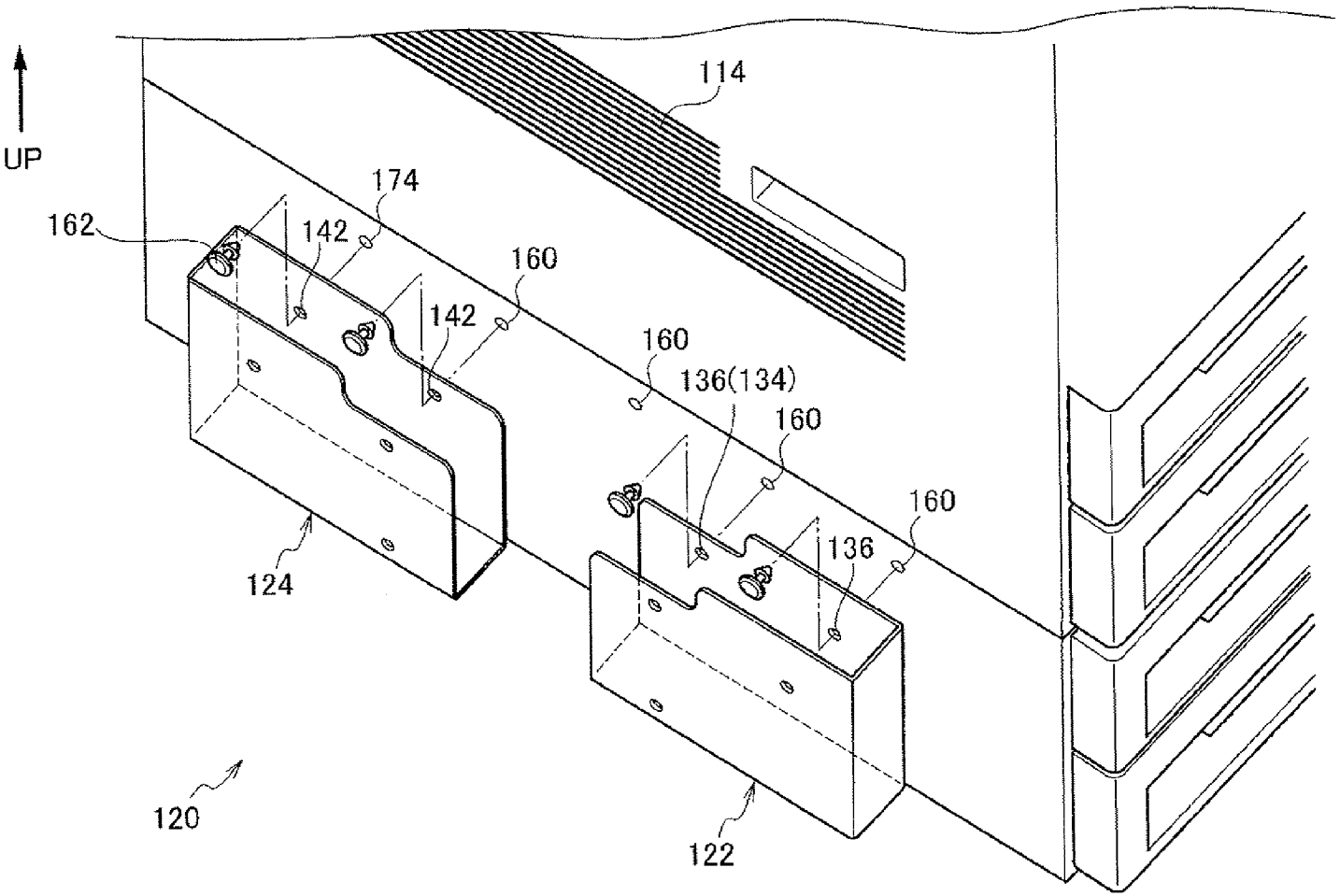
FIG. 6 is an enlarged perspective view illustrating a state where the width for storing the booklet is changed using the booklet storage according to the exemplary embodiment of the invention.
Figure 7:
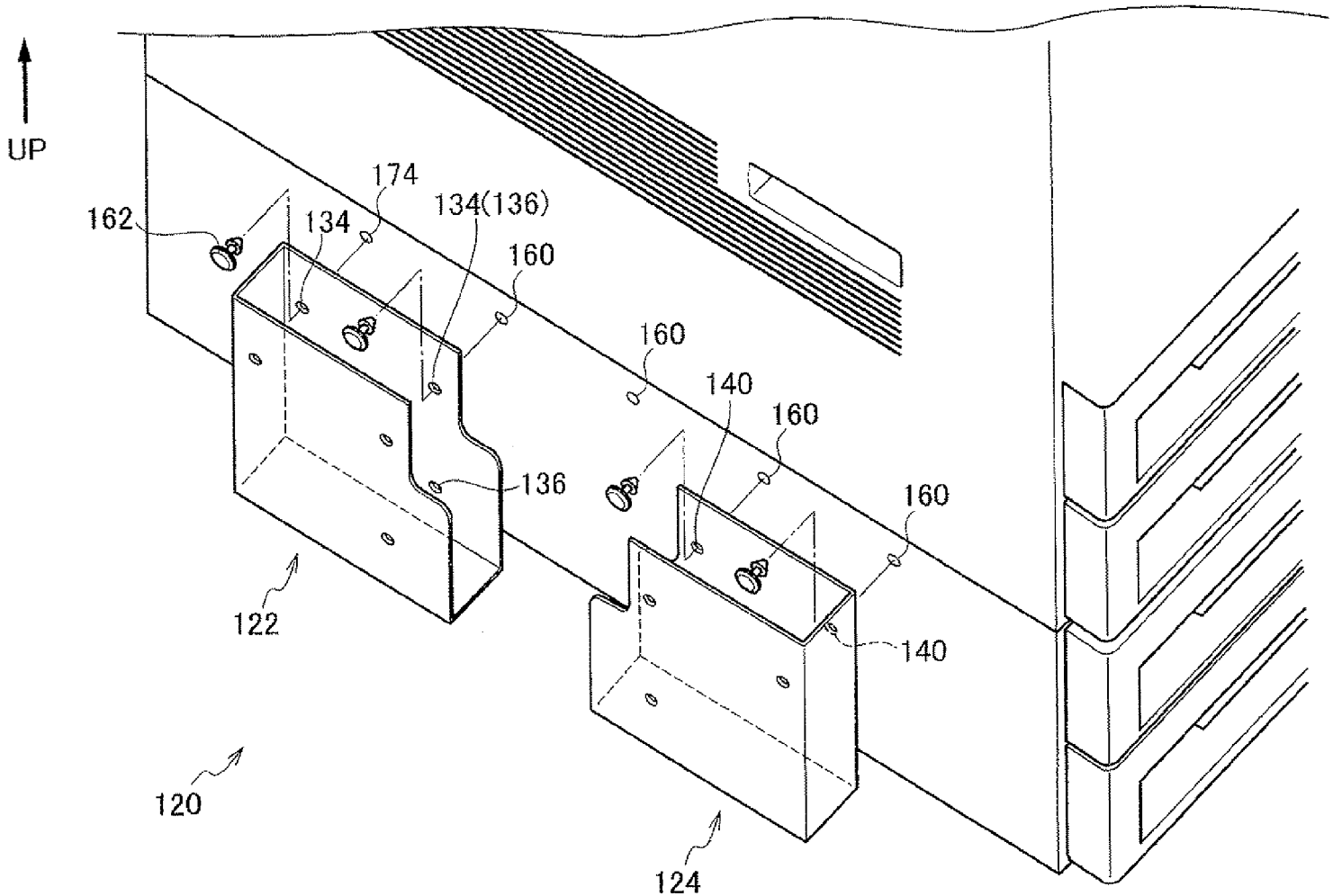
FIG. 7 is an enlarged perspective view illustrating another state where the width for storing the booklet is changed using the booklet storage according to the exemplary embodiment of the invention.

As shown in FIGS. 6 and 7, in the above-mentioned exemplary embodiment, the booklet storage 120 is divided into the first storage member 122 and the second storage member 124. Accordingly, by forming a particular attachment hole 174 in the side plate 116 and moving at least one of the first storage member 122 and the second storage member 124 in the horizontal direction, a booklet S of another size may be stored therein.

Figure 10A:
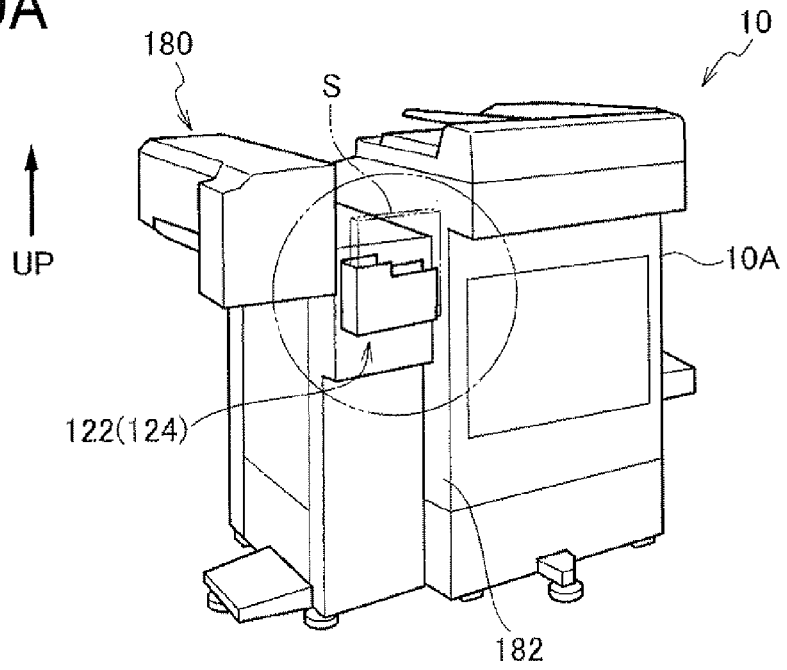
FIGS. 10A and 10B are perspective views illustrating a state where a booklet is stored using one member of the booklet storage according to the exemplary embodiment of the invention.
Figure 10B:
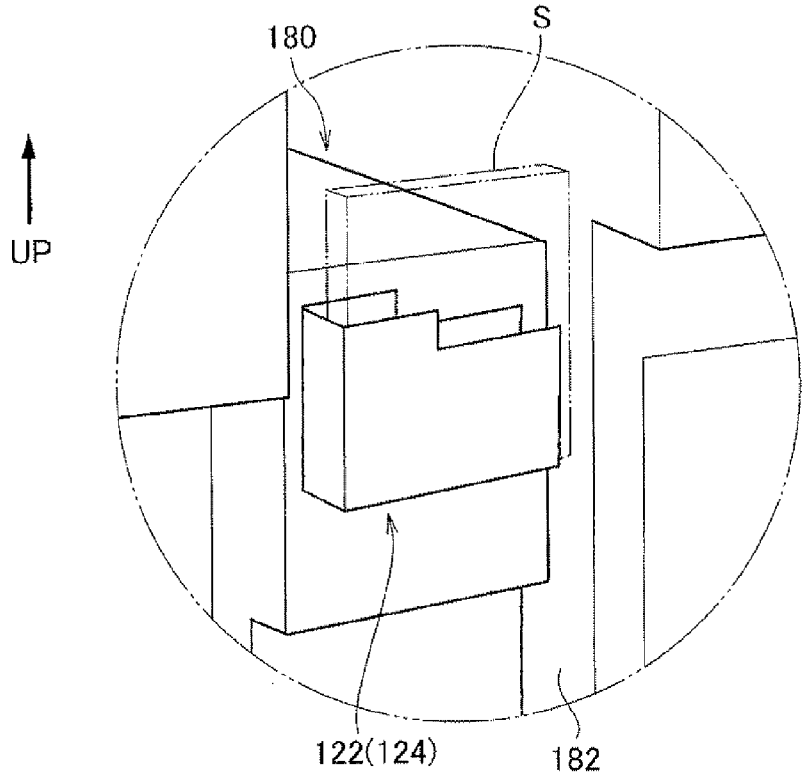

In the above-mentioned exemplary embodiment, the booklet storage 120 is divided into the first storage member 122 and the second storage member 124. Accordingly, a booklet S may be stored using any one thereof. For example, as shown in FIGS. 10A and 10B, when an optional device 180 such as a sorter is attached to a side surface of the apparatus body 10A, a stepped portion 182 may be formed between the optional device 180 and the apparatus body 10A. The storage space for a booklet S may be formed using the first storage member 122 or the second storage member 124 and the stepped portion 182.

Although not particularly stated in the above-mentioned exemplary embodiment, the first storage member 122 or the second storage member 124 may be disposed inclined using only the first storage member 122 or the second storage member 124 and a booklet S may be stored therein.

In the above-mentioned exemplary embodiment, the number of first attachment holes 134, the number of second attachment holes 136, the number of third attachment holes 140, and the number of fourth attachment holes 142 are two, but the numbers are not limited to two but may be three or more.

In the above-mentioned exemplary embodiment, the cutouts 128 and 130 for taking out the CD case K are formed in the first storage member 122 and the second storage member 124, but may be formed in only any one.

In the above-mentioned exemplary embodiment, the postures of the first storage member 122 and the second storage member 124 are determined in the longitudinal arrangement of a booklet by causing the opening edge 164 of the first receiver portion 122A and the opening edge 166 of the third receiver portion 124A to face each other. However, the shapes of the members may be determined so as to determine the postures of the first storage member 122 and the second storage member 124 by combining the opening edge 164 of the first receiver portion 122A and the opening edge 166 of the third receiver portion 124A with each other.

In the above-mentioned exemplary embodiment, both the attachment direction of the first storage member 122 and the attachment direction of the second storage member 124 are changed in the longitudinal arrangement of a booklet and in the transversal arrangement of a booklet. However, the shapes of the members may be determined so as to distinguish the longitudinal arrangement of a booklet and the transversal arrangement of a booklet by changing only one attachment direction.

In the above-mentioned exemplary embodiment, the first storage member 122 and the second storage member 124 are attached to the side plate 116 by the use of the fasteners 162. However, the first storage member 122 and the second storage member 124 may be attached to the side plate 116 by the use of a double-sided tape or the like. In this case, the relative positional relationship between the first storage member 122 and the second storage member 124 is determined by bringing the opening edge 168 of the second receiver portion 122B and the opening edge 170 of the fourth receiver portion 124B into contact with each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A booklet storage comprising:

a first storage member that includes a first receiver portion and a second receiver portion connecting with the first receiver portion; and a second storage member that includes a third receiver portion and a fourth receiver portion connecting with the third receiver portion, wherein the first storage member and the second storage member together receive a booklet in combination, and wherein a first width in a first configuration between the first receiver portion or the second receiver portion and the third receiver portion is different than a second width in a second configuration between the first receiver portion or the second receiver portion and the fourth receiver portion, wherein in the first configuration, the first receiver portion and the third receiver portion are disposed as bottom portions of the first storage member and the second storage member, respectively, and in the second configuration, the second receiver portion and the fourth receiver portion are disposed as the bottom portions of the first storage member and the second storage member, respectively, wherein the first storage member includes a plurality of first attachment portions used to attach the first storage member to an attachment member when the first width is formed with the second storage member, and a plurality of second attachment portions used to attach the first storage member to the attachment member when the second width is formed with the second storage member, wherein the second storage member includes a plurality of third attachment portions used to attach the second storage member to the attachment member when the first width is formed with the first storage member, and a plurality of fourth attachment portions used to attach the second storage member to the attachment member when the second width is formed with the first storage member, and wherein the relative positional relationship between the plurality of first attachment portions and the plurality of third attachment portions when the first storage member and the second storage member are arranged to form the first width is substantially identical to the relative positional relationship between the plurality of second attachment portions and the plurality of fourth attachment portions when the first storage member and the second storage member are arranged to form the second width.

2. The booklet storage according to claim 1, wherein a first opening edge of the first storage member and a second opening edge of the second storage member are placed oppositely with each other.

3. The booklet storage according to claim 2, wherein the first storage member and the second storage member have substantially the same shape.

4. The booklet storage according to claim 2, wherein the first storage member further includes a first wall portion that supports a cover face or a back cover face of the booklet, and the second storage member further includes a second wall portion that supports a cover face or a back cover face of the booklet, and wherein a cutout is formed in at least one of the first wall portion and the second wall portion.

5. The booklet storage according to claim 2, wherein the first storage member includes a plurality of first attachment portions used to attach the first storage member to an attachment member when the first width is formed with the second storage member, and a plurality of second attachment portions used to attach the first storage member to the attachment member when the second width is formed with the second storage member, wherein the second storage member includes a plurality of third attachment portions used to attach the second storage member to the attachment member when the first width is formed with the first storage member, and a plurality of fourth attachment portions used to attach the second storage member to the attachment member when the second width is formed with the first storage member, and wherein the relative positional relationship between the plurality of first attachment portions and the plurality of third attachment portions when the first storage member and the second storage member are arranged to form the first width is substantially identical to the relative positional relationship between the plurality of second attachment portions and the plurality of fourth attachment portions when the first storage member and the second storage member are arranged to form the second width.

6. The booklet storage according to claim 1, wherein an opening edge of the first receiver portion or the second receiver portion and the opening edge of the third receiver portion are placed oppositely with each other when the booklet is received using the first receiver portion or the second receiver portion and the third receiver portion, and wherein an opening edge of the first receiver portion or the second receiver portion and the opening edge of the fourth receiver portion are placed oppositely with each other when the booklet is received using the first receiver portion or the second receiver portion and the fourth receiver portion.

7. The booklet storage according to claim 6, wherein the first storage member and the second storage member have substantially the same shape.

8. The booklet storage according to claim 1, wherein the first storage member and the second storage member have substantially the same shape.

9. The booklet storage according to claim 1, wherein the first storage member further includes a first wall portion that supports a cover face or a back cover face of the booklet, and the second storage member further includes a second wall portion that supports a cover face or a back cover face of the booklet, and wherein a cutout is formed in at least one of the first wall portion and the second wall portion.

10. An electronic apparatus comprising:

the booklet storage according to claim 1; and an electronic apparatus body that includes an attachment portion to which the booklet storage is attached.

11. The electronic apparatus according to claim 10, wherein the electronic apparatus body is provided with an air inlet and outlet port that enables exchanging the air inside the electronic apparatus body and the air outside the electronic apparatus body, and wherein a position of the attachment portion is determined in a manner so that the air inlet and outlet port is not covered by the booklet stored in the booklet storage.

12. An electronic apparatus comprising:

the booklet storage according to claim 1; and an electronic apparatus body in which an attachment portion corresponding to the plurality of first attachment portions and the plurality of third attachment portions when the first storage member and the second storage member are arranged to form the first width and an attachment portion corresponding to the plurality of second attachment portions and the plurality of fourth attachment portions when the first storage member and the second storage member are arranged to form the second width are common.

13. A booklet storage comprising:

a first storage member that includes a first receiver portion receiving an end face of a booklet, and a second receiver portion connecting with the first receiver portion and receiving an end face of the booklet; and a second storage member that includes a third receiver portion receiving an end face of the booklet, and a fourth receiver portion connecting with the third receiver portion and receiving an end face of the booklet, wherein a first width, in a first configuration, at which the booklet is received in a posture in which the booklet is received using the first receiver portion or the second receiver portion and the third receiver portion is different than a second width, in a second configuration, at which the booklet is received in a posture in which the booklet is received using the first receiver portion or the second receiver portion and the fourth receiver portion, wherein in the first configuration, the first receiver portion and the third receiver portion are disposed as bottom portions of the first storage member and the second storage member, respectively, and in the second configuration, the second receiver portion and the fourth receiver portion are disposed as the bottom portions of the first storage member and the second storage member, respectively, wherein the first storage member includes a plurality of first attachment portions used to attach the first storage member to an attachment member when the first width is formed with the second storage member, and a plurality of second attachment portions used to attach the first storage member to the attachment member when the second width is formed with the second storage member, wherein the second storage member includes a plurality of third attachment portions used to attach the second storage member to the attachment member when the first width is formed with the first storage member, and a plurality of fourth attachment portions used to attach the second storage member to the attachment member when the second width is formed with the first storage member, and wherein the relative positional relationship between the plurality of first attachment portions and the plurality of third attachment portions when the first storage member and the second storage member are arranged to form the first width is substantially identical to the relative positional relationship between the plurality of second attachment portions and the plurality of fourth attachment portions when the first storage member and the second storage member are arranged to form the second width.

14. The booklet storage according to claim 13, wherein a first opening edge of the first storage member and a second opening edge of the second storage member are placed oppositely with each other.

15. The booklet storage according to claim 14, wherein the first storage member and the second storage member have substantially the same shape.

16. The booklet storage according to claim 14, wherein the first storage member further includes a first wall portion that supports a cover face or a back cover face of the booklet, and the second storage member further includes a second wall portion that supports a cover face or a back cover face of the booklet, and wherein a cutout is formed in at least one of the first wall portion and the second wall portion.

17. The booklet storage according to claim 14, wherein the first storage member includes a plurality of first attachment portions used to attach the first storage member to an attachment member when the first width is formed with the second storage member, and a plurality of second attachment portions used to attach the first storage member to the attachment member when the second width is formed with the second storage member, wherein the second storage member includes a plurality of third attachment portions used to attach the second storage member to the attachment member when the first width is formed with the first storage member, and a plurality of fourth attachment portions used to attach the second storage member to the attachment member when the second width is formed with the first storage member, and wherein the relative positional relationship between the plurality of first attachment portions and the plurality of third attachment portions when the first storage member and the second storage member are arranged to form the first width is substantially identical to the relative positional relationship between the plurality of second attachment portions and the plurality of fourth attachment portions when the first storage member and the second storage member are arranged to form the second width.

18. The booklet storage according to claim 13, wherein an opening edge of the first receiver portion or the second receiver portion and the opening edge of the third receiver portion are placed oppositely with each other when the booklet is received using the first receiver portion or the second receiver portion and the third receiver portion, and wherein the opening edge of the first receiver portion or the second receiver portion and the opening edge of the fourth receiver portion are placed oppositely with each other when the booklet is received using the first receiver portion or the second receiver portion and the fourth receiver portion.

19. The booklet storage according to claim 18, wherein the first storage member and the second storage member have substantially the same shape.

20. The booklet storage according to claim 13, wherein the first storage member and the second storage member have substantially the same shape.

21. The booklet storage according to claim 13, wherein the first storage member further includes a first wall portion that supports a cover face or a back cover face of the booklet, and the second storage member further includes a second wall portion that supports a cover face or a back cover face of the booklet, and wherein a cutout is formed in at least one of the first wall portion and the second wall portion.

22. An electronic apparatus comprising:

the booklet storage according to claim 13, and an electronic apparatus body that includes an attachment portion to which the booklet storage is attached.

23. The electronic apparatus according to claim 22, wherein the electronic apparatus body is provided with an air inlet and outlet port that enables exchanging the air inside the electronic apparatus body and the air outside the electronic apparatus body, and wherein a position of the attachment portion is determined in a manner so that the air inlet and outlet port is not covered by the booklet stored in the booklet storage.

24. An electronic apparatus comprising:

the booklet storage according to claim 13; and an electronic apparatus body in which an attachment portion corresponding to the plurality of first attachment portions and the plurality of third attachment portions when the first storage member and the second storage member are arranged to form the first width and an attachment portion corresponding to the plurality of second attachment portions and the plurality of fourth attachment portions when the first storage member and the second storage member are arranged to form the second width are common.

* * * * *